US012345274B1

(12) United States Patent
Seliga

(10) Patent No.: US 12,345,274 B1
(45) Date of Patent: Jul. 1, 2025

(54) TOW AND RIDE DEBRIS BLOWERS

(71) Applicant: James Seliga, Bellevue, OH (US)

(72) Inventor: James Seliga, Bellevue, OH (US)

( * ) Notice: Subject to any disclaimer, the term of this patent is extended or adjusted under 35 U.S.C. 154(b) by 94 days.

(21) Appl. No.: 18/205,543

(22) Filed: Jun. 4, 2023

Related U.S. Application Data

(60) Provisional application No. 63/349,710, filed on Jun. 7, 2022.

(51) Int. Cl.
*F04D 29/42* (2006.01)
*F04D 29/40* (2006.01)
*E01H 1/08* (2006.01)

(52) U.S. Cl.
CPC ..... *F04D 29/422* (2013.01); *F04D 29/403* (2013.01); *F04D 29/4226* (2013.01); *E01H 1/0809* (2013.01)

(58) Field of Classification Search
CPC ... F04D 29/422; F04D 29/403; F04D 29/4226
See application file for complete search history.

(56) References Cited

U.S. PATENT DOCUMENTS 4,227,280 A 10/1980 Comer
6,073,305 A 6/2000 Hesskamp
7,841,044 B1 11/2010 Weih
9,750,180 B2 9/2017 Pearson
11,589,522 B2 2/2023 Weihl
2016/0369819 A1* 12/2016 Lofy ..... F04D 29/424
2020/0084978 A1* 3/2020 Weihl ..... B62D 51/04

OTHER PUBLICATIONS

Model PB-18SPA* Assembly Instructions (manual for out front blower), Authored by Selbro, Inc., 5 pages, published between 2000 and 2008, Published by Selbro, Inc. in Bellevue, Ohio. Evidence of publication Affidavit by Jim Seliga, Owner of Selbro, Inc., signed Nov. 25, 2023.

Owner's Manual for Blower for Out Front Rotary Mowers, Authored by Selbro, Inc., 15 pages, published between 2000 and 2008, Published by Selbro, Inc. in Bellevue, Ohio. Evidence of publication Affidavit by Jim Seliga, Owner of Selbro, Inc., signed Nov. 25, 2023.

(Continued)

*Primary Examiner* — Sabbir Hasan
(74) *Attorney, Agent, or Firm* — Jerry Semer

(57) ABSTRACT

The invention is a debris blower horizontally mounted on a cart that can be fabricated to be towed or self-powered by a rider. The blower is mounted on the cart horizontally, with an air discharge chute on either side. The blower can also have a front and/or back discharge chute. The air travels from the blower in a circular pattern around the blower channel and escapes unimpeded through the discharge chutes. The air traveling in a circular pattern will also escape from the front and/or back discharge chute unimpeded. Deflectors control the amount of air that flows through the discharge chutes. The deflectors are operated by actuators that the user controls through controls on the unit or by remote control. The controls can be wireless.

11 Claims, 5 Drawing Sheets

(56) References Cited

OTHER PUBLICATIONS

Owner's Manual for Blower for Mid-Mount Mowers (Zero Turn Mowers), Authored by Selbro, Inc., 15 pages, published between 2000 and 2008, Published by Selbro, Inc. in Bellevue, Ohio. Evidence of publication Affidavit by Jim Seliga, Owner of Selbro, Inc., signed Nov. 25, 2023.

Attachment A, picture of a walk behind horizontal blower, pictures by Bradley G Hutcherson, 3 page, Blower produced between 1992 and 1994. Evidence of publication affidavit by Bradley G Hutcherson signed Nov. 3, 2023.

Seven Advertising brochures, Horizontal blowers, Authored by Selbro, Inc., 7 pages, published between 2000 and 2008, Moose River Publishing Co., St. Johnsbury, VT., Evidence of publication Affidavit by Jim Seliga, Owner of Selbro, Inc., signed Nov. 25, 2023.

* cited by examiner

TOW AND RIDE DEBRIS BLOWERS

FIELD OF INVENTION

This patent relates the field of debris blowers and, more particularly, to debris blowers that use a horizontally oriented blower assembly.

BACKGROUND OF THE INVENTION

Debris blowers are prevalent for many yard and landscape maintenance tasks. Today, most debris blowers are centrifugal fan blowers vertically oriented mounted on a cart-style frame, requiring a user to push the cart to direct the blower manually, or the debris blower is a centrifugal fan blower vertically oriented towed behind a tractor or other large yard vehicle. Cart-style blowers are not practical in large areas and/or across varied landscapes. This style of blower is labor-intensive and awkward to handle. Vertically mounting on a tow behind cart or tractor is impractical and does not use the blower efficiently. For a blower to be efficient, it must discharge undeflected air in at least two directions. It must drive air from at least both sides of the cart. The blower will discharge air in three directions, both sides, and the front or back, in its most efficient form. This can only be accomplished by a horizontally mounted blower. A vertical blower can only discharge unimpeded air in one direction, but a horizontally mounted blower can discharge unimpeded air in any direction. A vertically mounted blower can only drive the air in one direction without deflection.

The features that make the inventor's tow behind debris blower superior to others on the market are as follows: First, the inventor's tow behind debris blower can blow left and right simultaneously. The invention can blow left and right with equal velocity on either side. In another version, the pressurized air velocity can be controlled independently for each side. The air velocity and amount are controlled by internal deflectors within the invention, which a wireless remote can operate within the towed vehicle. The same wireless remote can also regulate the blower's engine. The power source for the controls on the towed debris blower can be powered by energy from the towing vehicle or by an alternator on the motor for the blower.

SUMMARY OF THE INVENTION

The invention is a debris blower horizontally mounted on a cart that can be fabricated to be towed or self-powered by a rider. The blower is mounted on the cart horizontally, with an air discharged chute in the front and back pointing to either side. The blower can also have a discharge channel in the front or back. The air travels from the blower in a circular pattern around the blower channel and escapes through the unimpeded side-discharge channels. The air traveling in a circular pattern will also escape from the front and/or back discharge channels unimpeded. Within the discharge channels are deflectors that control the air flowing through the discharge channels. The deflectors are operated by actuators that the user controls through controls on the unit or by remote control.

DETAILED DESCRIPTION OF THE PREFERRED EMBODIMENT

Figure 1:
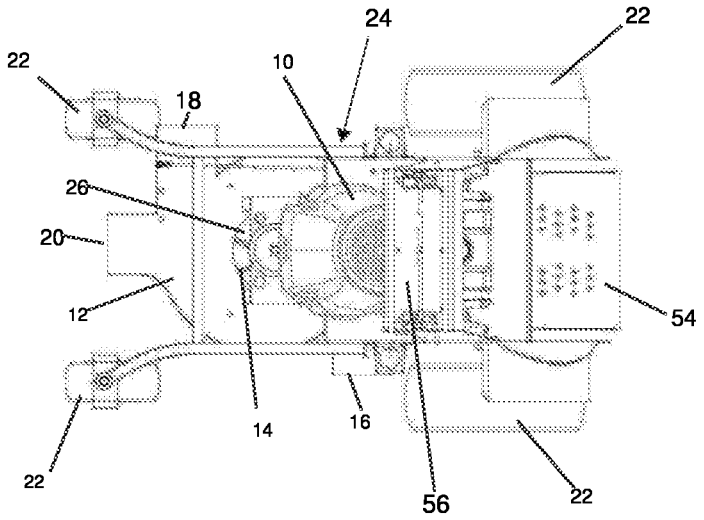
FIG. 1 is a top view of the one embodiment of the invention.
Figure 1A:
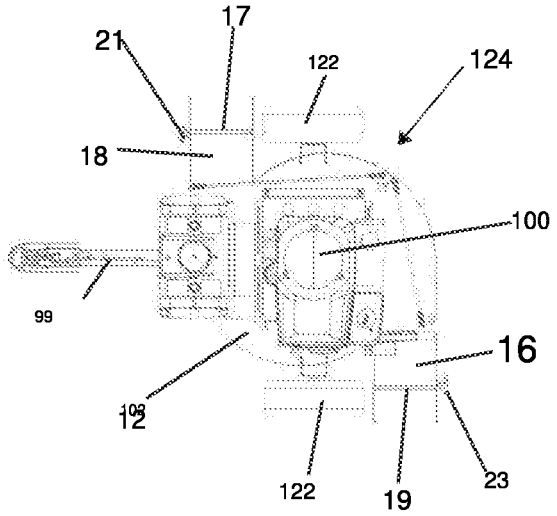
FIG. 1A is a top view of another embodiment of the invention.

FIG. 1 is a top view of one of the embodiments of the invention. FIG. 1 shows engine with alternator 10, which powers the blower 14 and the wheels 22. In the preferred embodiment, engine with alternator 10 is an internal combustion engine. However, engine with alternator 10 can be any engine known in the art to drive the blower 14 and the wheels 22. One or more electric engines will probably accomplish this in the future. Beneath engine with alternator 10 is the blower assembly 12. The blower assembly 12 holds the blower 14. The blower assembly 62 has three outlets, 16, 18, and 20, discharging air from blower 14. FIGS. 1 and 1A show that the blower assemblies 12 and 62 are mounted horizontally on the towed debris blower 124 and the riding debris blower 24. Mounting the blower assembly 62 horizontally enables the riding debris blower 24 to discharge the unimpeded airflow from the blower 14 in three different directions, left side, right side, and front, through the three discharge chutes 16. 18 and 20. This is impossible with a vertically oriented blower. A vertically mounted blower can only discharge the flow of air in two directions and one direction unimpeded. A horizontally mounted blower is more efficient than a vertical blower.

FIG. 1 also shows air inlets 26 for blower 14. These air inlets allow the air to flow into the blower, where the air pressure is boosted and directed to be discharged through the outlets. The riding debris blower 24 includes rear wheels 22 and front wheels 22. The wheels 22 may be configured as independently drivable wheels, driven in forward and reverse directions. The operator's platform 54 is what the operator stands on when driving and using the riding debris blower 24. The operator controls the riding debris blower 24 using user control 56, located in front and above the operator's platform 54. The user controls 56 are positioned approximately waist-high in front of the operator's platform 54.

FIG. 1A is a top view of another embodiment of the invention. FIG. 1A shows a blower that can be towed behind a tractor or mower. FIG. 1A shows engine with alternator 100, which powers the blower 14. In the preferred embodiment, engine with alternator 100 is an internal combustion engine. However, engine with alternator 100 can be any engine known in the art that could drive the blower. One or more electric engines will probably accomplish this in the future. Beneath engine with alternator 100 is blower assembly 12. The blower assembly 12 holds the blower 14. Blower assembly 12 has two discharge chutes, 16 and 18, that discharge air from blower 14. As shown in FIG. 1, blower assembly 12 is mounted in a horizontal position on the towed debris blower 124. Mounting the blower assembly 12 horizontally enables the towed debris blower 124 to discharge the unimpeded airflow from the blower 14 in two different directions, left side, and right side, through the two discharge chutes 16 and 18. This is impossible with a vertically oriented blower. A vertically mounted blower can only discharge the flow of air in one direction unimpeded. A horizontally mounted blower is more efficient than a vertical blower. The towed debris blower 124 can be designed to discharge the airflow in three directions unimpeded by using the blower assembly 62. The towed debris blower 124 could discharge the flow of air from the two sides and the rear with blower assembly 62.

Figure 2:
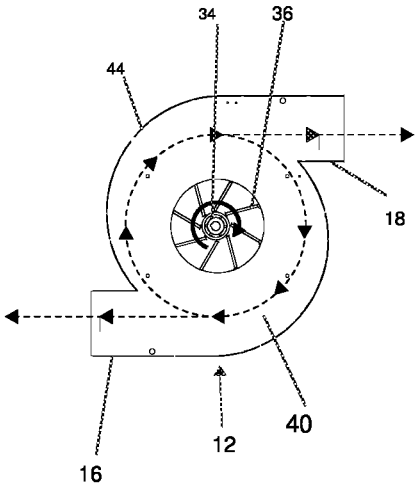
FIG. 2 is a cross-sectional view of blower assembly 12.

FIG. 2 is a cross-sectional view of blower assembly 12 in accordance with aspects of the disclosure shown. It is to be understood that the size, spacing, and/or orientation of the various features of blower assembly 12 are not to scale and are merely for illustrative purposes. The blower assembly 12 includes an impeller 34 having a plurality of impeller blades 36 which, when rotated by the power source (an internal combustion engine 10 (in FIG. 1), generate a stream of air that is delivered through the blower assembly 12 and out of one or both of side discharge chute 16 and 18. Blower assembly 12 includes an annular channel 40 bounded by an outer wall 44. As impeller 34 rotates, external air is drawn through one or more air inlet openings 26 (shown in FIG. 1) and forced through the annular channel 40.

In the configuration shown in FIG. 2, the blower assembly 12 is configured such that air generated by impeller 34 passes through annular channel 40 and out left side discharge chute 16 and right side discharge chute 18. The air discharged from chutes 16 and 18 simultaneously can be equal in this configuration. Further, there is no impedance in the airflow through the annular channel 40 and out the discharge chutes 16 and 18.

Figure 2A:
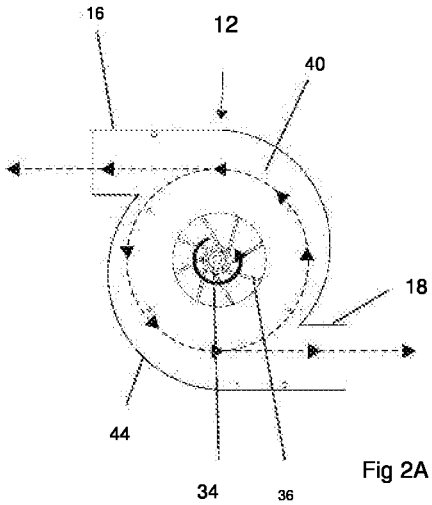
FIG. 2A is a cross-sectional view of blower assembly 12 that has been flipped over from the view of FIG. 2.

FIG. 2A is exactly like and works the same as FIG. 2, except FIG. 2A has been flipped over, right side discharge chute 18 is at the bottom, and left side discharge chute 16 is at the top. As in FIG. 2, blower assembly 12 includes an annular channel 40 bounded by an outer wall 44. As impeller 34 rotates, external air is drawn through one or more air inlet openings 26 (shown in FIG. 1) and forced through the annular channel 40. The air produced by impeller 34 passes through annular channel 40 and out left side discharge chute 16 and right side discharge chute 18. The air discharged from chutes 16 and 18 simultaneously can be equal in this configuration. Further, there is no impedance in the airflow through the annular channel 40 and out the discharge chutes 16 and 18.

Figure 3:
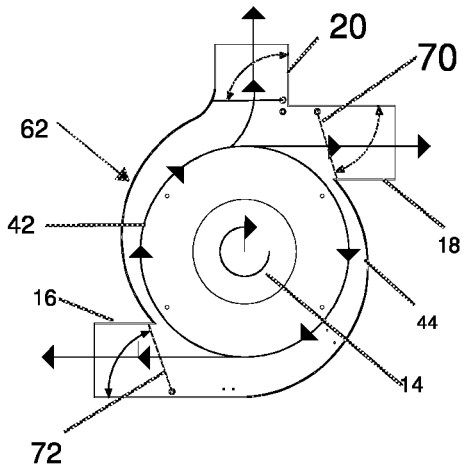
FIG. 3 is a cross-sectional view of blower assembly 62.

As in FIG. 1, FIG. 3 shows three discharge chutes, 16, 18, and 20. FIG. 3 is a cross-sectional view of blower assembly 62 in accordance with aspects of the disclosure. FIG. 3 shows discharge chute 20 in the front of the blower assembly. The blower assembly 62 includes an annular channel 42 bounded by an outer wall 44. As blower 14 rotates, external air is drawn through one or more air inlet openings 26, shown in FIG. 1, and forced through the annular channel 42.

In the configuration shown in FIG. 3, the blower assembly 62 is configured such that airflow generated by the blower 14 passes through annular channel 40 and out left side discharge chute 16, right side discharge chute 18, and the front discharge chute 20. The air is simultaneously discharged from discharge chutes 16, 18, and 20. The airflow from all three discharge chutes 16, 18, and 20 can be equal in this configuration. Further, there is no impedance in the airflow through the annular channel 40 and out the discharge chutes 16, 18, and 20.

Figure 3A:
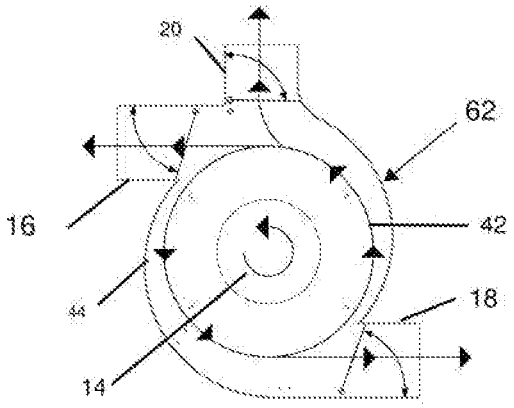
FIG. 3A is a cross-sectional view of blower assembly 62 that has been flipped over from the view of FIG. 3.

FIG. 3A is exactly like and works the same as FIG. 3, except FIG. 3A has been flipped over, right side discharge chute 18 is at the bottom, and left side discharge chute 16 is at the top. As in FIG. 3, blower assembly 62 includes an annular channel 40 bounded by an outer wall 44. As impeller 34 rotates, external air is drawn through one or more air inlet openings 26 (shown in FIG. 1) and forced through the annular channel 40. The air produced by impeller 34 passes through annular channel 40 and out left side discharge chute 16 and right side discharge chute 18, and front discharge chute 20. The air discharged from chutes 16, 18, and 20 simultaneously can be equal in this configuration. Further, there is no impedance in the airflow through the annular channel 40 and out the discharge chutes 16, 18, and 20.

Figure 4:
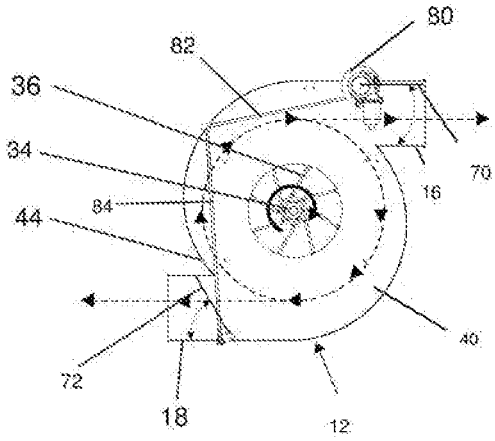
FIG. 4 is a cross-sectional view of blower assembly 12, showing the actuators.

FIG. 4 is a cross-sectional view of blower assembly 12, the same as FIG. 2, with two discharge chutes 16 and 18. In FIG. 4, deflectors 70 and 72 have been added to discharge chutes 16 and 18. In discharge chute 18, a deflector 70 has been added, and in discharge chute 16, a deflector 72 has been added. Deflectors 70 and 72 impede airflow out of chutes 16 and 18. Deflector 70 is attached to the wall of discharge chute 18, and deflector 72 is attached to the wall of discharge chute 16. Deflectors 70 and 72 can be pivoted out from the walls of discharge chutes 16 and 18. FIG. 4 shows deflector 72 pivoted out to completely close discharge chute 16 so no air can flow through. Deflector 70 is not pivoted away from the wall of discharge chute 18. Thus deflector 72 allows the entire air flow through discharge chute 16 unimpeded. Deflectors 70 and 72 can partially impede airflow through discharge chutes 16 and 18 or fully inhibit or fully allow airflow through discharge chutes 16 and 18. As in fingers 2, 2A, 3, and 3A, FIG. 4 can be flipped over, with right side discharge chute 18 at the bottom and left side discharge chute 16 at the top.

Deflectors 70 and 72 are attached to the walls of discharge chutes 16 and 18 with pivots. Deflectors 70 and 72 are moved by actuators 80, as shown in FIG. 4. Actuator 80 is attached to deflector 70, and its motor can move deflector 70. The actuator 80 is controlled by controls on the user control 56 for the riding debris blower 24. In FIG. 4, actuator 80 is also attached to deflector 72 through rods 82 and 84. Actuator 80 can also control the amount of pivot of deflector 72. Since both deflectors 70 and 72 are controlled by actuator 80, they will move simultaneously. However, each leg could have a separate actuator and be moved independently. For the riding debris blower 24, the movement of deflectors 70 and 72 are also controlled by the operator with the controls on the user control 56. For the towed debris blower 124, the operator controls the movement of deflectors 70 and 72 with a remote control shown in FIG. 6.

Figure 5:
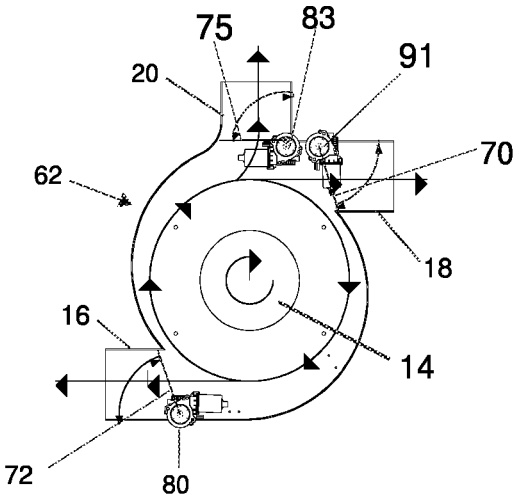
FIG. 5 is a cross-sectional view of blower assembly 62, showing the actuators.

FIG. 5 is a cross-sectional view of blower assembly 62, the same as FIG. 3, with three discharge chutes, 16, 18, and 20. FIG. 5 shows discharge chutes 16, 18, and 20 contain deflectors 70, 72, and 75. In discharge chute 16, a deflector 72 has been added, in discharge chute 18, deflector 70 has been added, and in discharge chute 20, deflector 75 has been added. Deflectors 70, 72, and 75 impede airflow from discharge chutes 16, 18, and 20. The deflector 70 is pivotally attached to the wall of discharge chute 18, the deflector 72 is pivotally attached to the wall of discharge chute 16, and the deflector 75 is pivotally attached to the wall of discharge chute 20. Deflectors 70, 72, and 75 can be pivoted out from the walls of discharge chutes 16. 18, and 20. FIG. 5 shows that deflectors 70, 72, and 75 pivoted to completely close discharge chutes 16, 18, and 20 so no air could flow through. Deflectors 70, 72, and 75 can be pivoted against the wall of discharge chutes 16, 18, and 20, allowing air to flow through discharge chutes 16, 18, and 20 unimpeded. Deflectors 70, 72, and 75 can be rotated outward to impede airflow through discharge chutes 16, 18, and 20 partially or fully inhibit or fully allow airflow through discharge chutes 16, 18, and 20. Deflectors 70, 72, and 75 and be rotated independently or in concert.

FIG. 5 shows the means for rotating deflectors 70, 72, and 75. Deflectors 70, 72, and 75 are moved by actuators 80, 91, and 83, as shown in FIG. 5. Actuator 80 is attached to deflector 72, and its motor can move deflector 72. In FIG. 5, actuator 91 is attached to deflector 70, and actuator 83 is attached to deflector 75. The three actuators, 80, 91, and 83, are controlled independently. Thus deflector 75 could fully block discharge chute 20, and deflectors 70 and 72 could allow the air to flow through discharge chutes 16 and 18. However, any two deflectors or all three deflectors 70, 72, and 75 could be attached as the deflectors 70 and 72 are in FIG. 4. For the riding debris blower 24, the operator controls the movement of deflectors 70, 72, and 75 with the controls on user control 56. For the towed debris blower 124, the operator controls the movement of deflectors 70, 72, and 75 with remote control 200, shown in FIG. 6.

On the towed debris blower 124, the actuators 80, 91, and 83 can be powered by two methods. In the first method, the towing vehicle's power system could provide the power for actuators 80, 91, and 83. Line 99 runs from the towing vehicle down the tongue of the towed debris blower, bringing the power to control actuators 80, 91, and 83 or other actuators on the towed debris blower. The power from the towing vehicle controls the motors within actuators 80, 91, and 83, allowing them to move deflectors 70, 72, and 75. Line 99 also brings power from the towing vehicle to the electronic control for the engine throttle. The wireless communication system that controls the actuators 80, 91, and 83 and the engine throttle are also driven by the power from the towing vehicle through line 99. Each actuator 80, 91, and 83 and the engine throttle contain a control unit that communicates with the remote control unit 200 and enables the operator of the remote control unit 200 to control the actuators. These control units are powered by energy from the towing vehicle through line 99.

For the second method, engine with alternator 10 drives blower 14 on the towed debris blower 124 powers the actuators 80, 91, and 83 and the electronic controls for the engine. Engine with alternator 10 has an onboard alternator that provides the electric power for actuators 80, 19, and 83 allowing them to move deflectors 70, 72, and 75 and the electronic controls for the engine. The wireless communication system that controls the actuators 80, 91, and 83 and the engine throttle is also driven by the power from the alternator. Each actuator 80, 91, and 83 and the engine throttle contain a control unit that communicates with the remote control unit 200 and enables the operator of the remote control unit 200 to control the actuators 80, 91, and 83 and the engine throttle. These control units are powered by energy from the alternator.

A battery on the towed debris blower 124 can also bring power to control actuators 80, 91, and 83 or other actuators, the controls for the engine throttle, and the wireless communication.

A manually controlled flap can control the airflow through the discharge chutes. FIG. 1A shows at the end of discharge chutes 16 and 18 a manually controlled flap 17 and 19. The flaps 17 and 19 are pivoted vertically in the opening of discharge chutes 16 and 18. The flaps 17 and 19 can be pivoted from a horizontal position downward to lessen the flow of pressurized air from the discharge chutes 16 and 18. The pivoting of flaps 17 and 19 are operated by knobs 21 and 23 on chutes 16 and 18. Discharge chutes 16, 18, and 20 on the riding debris blower 24 can also have manually controlled flaps maneuvered by knobs.

Figure 6:
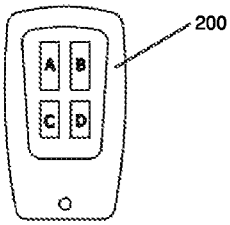
FIG. 6 is a view of the remote control.

FIG. 6 shows the remote control 200. The remote control 200 wirelessly controls the deflectors 70, 72, and 75 on the towed debris blower 124. Each actuator 80, 91, and 83 and the engine throttle contain a control unit that wirelessly communicates with the remote control unit 200 and enables the operator of the remote control unit 200 to control the actuators 80, 91, and 83 and the engine throttle.

I claim:

1. A debris blower that can be towed comprising:

a) A blower housing;

b) an annular channel formed within the blower housing;

c) an impeller, horizontally oriented, rotatable within the blower housing configured to force a stream of air through the annular channel;

d) a first side opening in the blower housing;

e) a first discharge chute attached to the first side opening that discharges air from the blower;

f) a second side opening in the blower housing;

g) a second discharge chute attached to the second side opening that discharges air from the blower;

h) said annular channel has no impedance to the flow of air;

i) said first and second side openings are positioned to allow an equal amount of air to flow into said first and second discharge chutes;

j) a first power source to drive the impeller;

k) a tongue with a hitch;

l) a set of wheels;

m) a rear opening;

n) a rear discharge chute attached to the rear opening that discharges air from the blower;

o) said rear opening is positioned to allow an equal amount of air to flow into said first and second and rear discharge chutes.

2. The debris blower that can be towed comprising;

a) blower housing;

b) an annular channel formed within the blower housing;

c) an impeller, horizontally oriented, rotatable within the blower housing configured to force a stream of air through the annular channel;

d) a first side opening in the blower housing;

e) a first discharge chute attached to the first side opening that discharges air from the blower;

f) a second side opening in the blower housing;

g) a second discharge chute attached to the second side opening that discharges air from the blower;

h) said annular channel has no impedance to the flow of air;

i) said first and second side openings are positioned to allow an equal amount of air to flow into said first and second discharge chutes;

j) a first power source to drive the impeller;

k) a tongue with a hitch;

l) a set of wheels;

m) a first deflector placed in the first discharge chute to impede the flow of air discharged through the first discharge chute;

n) a second deflector placed in the second discharge chute to impede the flow of air discharged through the second discharge chute;

o) a first actuator attached to the first deflector, and said the first actuator manipulates the first deflectors to manage how much air is discharged through the first discharge chute;

p) a second actuator attached to the second deflector, and said second actuator manipulates the second deflectors to manage how much air is discharged through the second discharge chute;

q) a second power source that drives the first and second actuators;

r) a control system that allows an operator of the blower to manage the output of air through the first and second discharge chutes;

s) the second power source drives the control system.

3. The debris blower that can be towed, as in claim 2, wherein;

a. the control system manipulates the first and second actuators independently, allowing different amounts of air to be discharged through the first and second discharge chutes.

4. The debris blower that can be towed, as in claim 2, further comprising;

a. a rear opening:

b. a rear discharge chute attached to the rear opening that discharges air from the blower;

c. said rear opening is positioned to allow an equal amount of air to flow into said first and second and rear discharge chutes;

d. a rear deflector placed in the rear discharge chute to impede the flow of air discharged through the rear discharge chute;

e. a rear actuator attached to the rear deflector, and said the rear actuator manipulates the rear deflector to manage how much air is discharged through the rear discharge chute;

f) the control system allows an operator of the blower to manage the output of air through the first, second, and rear discharge chutes;

g) the second power source fuels the control system and the rear actuator.

5. The debris blower that can be towed, as in claim 2, further comprising;

a) the control system comprises;

1. a means for controlling the first and second actuators that manipulate the first and second deflectors;

2. a remote control means for the operator of the debris blower to send directions to the means for controlling the first and second actuators.

6. The debris blower that can be towed, as in claim 5, wherein;

a. the remote control is a wireless remote control.

7. The debris blower that can be towed, as in claim 5, whereas:

a) the second power source comprises an electrical line that runs down the tongue and attaches the control system to the power system of the towing vehicle.

8. The debris blower that can be towed, as in claim 5, whereas:

a) the second power source comprises an alternator driven by the first power source.

9. The debris blower that can be towed, as in claim 5, whereas:

a) a means to control the throttle of the first power source;

b) a remote control means for the operator of the debris blower to send directions to the means to control the throttle of the first power source;

c) the second power source drives the means to control the throttle of the first power source.

10. The debris blower that can be towed, as in claim 9, whereas:

a) the second power source comprises an electrical line that runs down the tongue and attaches the control system to the power system of the towing vehicle and the means to control the throttle of the first power source.

11. The debris blower that can be towed, as in claim 9, whereas:

a) the second power source comprises an alternator driven by the first power source.

* * * * *